US007252591B2

(12) United States Patent
Van Asdale

(10) Patent No.: US 7,252,591 B2
(45) Date of Patent: Aug. 7, 2007

(54) GAMING DEVICE HAVING SYMBOL STACKS

(75) Inventor: Shawn M. Van Asdale, Reno, NV (US)

(73) Assignee: IGT, Reno, NV (US)

( * ) Notice: Subject to any disclaimer, the term of this patent is extended or adjusted under 35 U.S.C. 154(b) by 710 days.

(21) Appl. No.: 10/209,704

(22) Filed: Jul. 31, 2002

(65) Prior Publication Data

US 2004/0023714 A1 Feb. 5, 2004

(51) Int. Cl.
*A63F 9/24* (2006.01)

(52) U.S. Cl. ..... 463/22; 463/20

(58) Field of Classification Search ..... 463/16–22
See application file for complete search history.

(56) References Cited

U.S. PATENT DOCUMENTS 2,545,644 A 3/1951 Benton
4,198,052 A 4/1980 Gauselmann
4,258,838 A 3/1981 Rockola et al.
4,410,178 A 10/1983 Partridge
4,448,419 A 5/1984 Telnaes
4,513,970 A 4/1985 Opresco et al.
4,560,161 A 12/1985 Hamano
4,582,324 A 4/1986 Koza et al.
4,586,713 A 5/1986 Abu-Shumays et al.
4,618,150 A 10/1986 Kimura
4,624,459 A 11/1986 Kaufman
4,695,053 A 9/1987 Vazquez, Jr. et al.
4,706,956 A 11/1987 Abu-Shumays et al.
4,711,451 A * 12/1987 Pajak et al. ..... 463/22
4,722,527 A * 2/1988 Gauselmann ..... 273/143 R
4,756,531 A 7/1988 DiRe et al.
4,805,907 A 2/1989 Haiwara
4,817,952 A 4/1989 Biro et al.
4,836,553 A 6/1989 Suttle et al.
4,838,552 A * 6/1989 Hagiwara ..... 463/20
4,844,467 A 7/1989 Gyenge et al.
4,861,041 A 8/1989 Jones et al.
4,871,171 A 10/1989 Rivero
4,874,173 A 10/1989 Kishishita (Continued)

FOREIGN PATENT DOCUMENTS

AU 1997 16432 B2 9/1997

(Continued)

OTHER PUBLICATIONS

Slot Machines Article by Marshall Fey, published 1983, 1989, 1991, 1994 and 1997.

(Continued)

*Primary Examiner*—Robert E. Pezzuto
*Assistant Examiner*—Jasson H. Yoo
(74) *Attorney, Agent, or Firm*—Bell, Boyd & Lloyd LLP

(57) ABSTRACT

A gaming device is provided including a set of symbols on a plurality of reels and a symbol stack that includes an initially displayed symbol and at least one initially hidden symbol. In one embodiment, the hidden symbols are stacked beneath the displayed symbol. The initially displayed symbol may be removed to reveal an initially hidden symbol so that one or more different sets of visible symbols appears on the display device.

49 Claims, 9 Drawing Sheets

U.S. PATENT DOCUMENTS

| | | | | |
|---|---|---|---|---|
| 4,889,340 | A | | 12/1989 | Greene |
| 4,991,848 | A | | 2/1991 | Greenwood et al. |
| 5,019,973 | A | | 5/1991 | Wilcox et al. |
| 5,033,744 | A | | 7/1991 | Bridgeman et al. |
| 5,085,436 | A | | 2/1992 | Bennett |
| 5,092,598 | A | * | 3/1992 | Kamille ..... 273/139 |
| 5,098,107 | A | | 3/1992 | Boylan et al. |
| 5,102,134 | A | | 4/1992 | Smyth |
| 5,102,137 | A | | 4/1992 | Ekiert |
| 5,167,413 | A | | 12/1992 | Fulton |
| 5,178,390 | A | | 1/1993 | Okada |
| 5,205,555 | A | | 4/1993 | Hamano |
| 5,209,479 | A | | 5/1993 | Nagao et al. |
| 5,211,399 | A | | 5/1993 | Howard |
| 5,249,800 | A | | 10/1993 | Hilgendorf et al. |
| 5,259,616 | A | | 11/1993 | Bergmann |
| 5,288,077 | A | | 2/1994 | Jones |
| 5,288,081 | A | | 2/1994 | Breeding |
| 5,332,219 | A | | 7/1994 | Marnell, II et al. |
| 5,342,047 | A | | 8/1994 | Heidel et al. |
| 5,342,049 | A | | 8/1994 | Wichinsky et al. |
| 5,362,052 | A | | 11/1994 | Kubatsch |
| 5,364,100 | A | | 11/1994 | Ludlow et al. |
| 5,364,105 | A | | 11/1994 | Jones |
| 5,377,973 | A | | 1/1995 | Jones et al. |
| 5,393,057 | A | | 2/1995 | Marnell, II |
| 5,393,061 | A | | 2/1995 | Manship et al. |
| 5,395,111 | A | | 3/1995 | Inoue |
| 5,407,200 | A | | 4/1995 | Zalabak |
| 5,429,507 | A | | 7/1995 | Kaplan |
| 5,431,407 | A | | 7/1995 | Hofberg et al. |
| 5,437,462 | A | | 8/1995 | Breeding |
| 5,452,899 | A | | 9/1995 | Skratulia et al. |
| 5,456,465 | A | | 10/1995 | Durham |
| 5,490,670 | A | | 2/1996 | Hobert |
| 5,494,287 | A | | 2/1996 | Manz |
| 5,511,781 | A | | 4/1996 | Wood et al. |
| 5,524,888 | A | | 6/1996 | Heidel |
| 5,529,309 | A | | 6/1996 | Bartlett |
| 5,531,440 | A | | 7/1996 | Dabrowski et al. |
| 5,531,441 | A | | 7/1996 | Dabrowski et al. |
| 5,536,016 | A | | 7/1996 | Thompson |
| 5,542,669 | A | | 8/1996 | Charron et al. |
| 5,560,603 | A | | 10/1996 | Seelig et al. |
| 5,569,084 | A | | 10/1996 | Nicastro et al. |
| 5,577,731 | A | | 11/1996 | Jones |
| 5,584,485 | A | | 12/1996 | Jones et al. |
| 5,607,162 | A | | 3/1997 | Boylan et al. |
| 5,611,535 | A | | 3/1997 | Tiberio |
| 5,626,341 | A | | 5/1997 | Jones et al. |
| 5,642,882 | A | | 7/1997 | Guerzini |
| 5,642,884 | A | | 7/1997 | Pitcher |
| 5,647,798 | A | | 7/1997 | Falciglia |
| 5,655,965 | A | | 8/1997 | Takemoto et al. |
| 5,660,391 | A | | 8/1997 | Klasee |
| 5,660,393 | A | | 8/1997 | Dreger |
| 5,664,781 | A | | 9/1997 | Feola |
| 5,711,525 | A | | 1/1998 | Breeding |
| D392,340 | S | | 3/1998 | DeSimone |
| 5,722,891 | A | | 3/1998 | Inoue |
| 5,732,948 | A | | 3/1998 | Yoseloff |
| 5,743,524 | A | | 4/1998 | Nannicola |
| 5,752,881 | A | | 5/1998 | Inoue |
| 5,766,074 | A | | 6/1998 | Cannon et al. |
| 5,769,716 | A | | 6/1998 | Saffari et al. |
| 5,772,509 | A | | 6/1998 | Weiss |
| 5,775,692 | A | | 7/1998 | Watts et al. |
| 5,788,573 | A | | 8/1998 | Baerlocher et al. |
| 5,794,964 | A | | 8/1998 | Jones et al. |
| 5,795,225 | A | | 8/1998 | Jones et al. |
| 5,807,172 | A | | 9/1998 | Piechowiak |
| 5,823,873 | A | | 10/1998 | Moody |
| 5,823,874 | A | | 10/1998 | Adams |
| 5,833,536 | A | | 11/1998 | Davids et al. |
| 5,836,041 | A | | 11/1998 | Kleinpell, II et al. |
| 5,848,932 | A | | 12/1998 | Adams |
| 5,851,148 | A | | 12/1998 | Brune et al. |
| 5,855,514 | A | | 1/1999 | Kamille |
| 5,863,041 | A | | 1/1999 | Boylan et al. |
| 5,873,781 | A | | 2/1999 | Keane |
| 5,882,261 | A | | 3/1999 | Adams |
| 5,885,157 | A | | 3/1999 | Harada et al. |
| 5,890,962 | A | | 4/1999 | Takemoto |
| 5,911,418 | A | | 6/1999 | Adams |
| 5,919,088 | A | | 7/1999 | Weiss |
| 5,927,714 | A | | 7/1999 | Kaplan |
| 5,934,672 | A | | 8/1999 | Sines et al. |
| 5,935,002 | A | | 8/1999 | Falciglia |
| 5,947,820 | A | | 9/1999 | Morro et al. |
| 5,951,397 | A | | 9/1999 | Dickinson |
| 5,964,463 | A | | 10/1999 | Moore, Jr. |
| 5,967,894 | A | | 10/1999 | Kinoshita et al. |
| 5,980,384 | A | | 11/1999 | Barrie |
| 5,984,781 | A | | 11/1999 | Sunaga |
| 5,996,997 | A | | 12/1999 | Kamille |
| 5,997,400 | A | | 12/1999 | Seelig et al. |
| 5,997,401 | A | | 12/1999 | Crawford |
| 6,004,207 | A | | 12/1999 | Wilson, Jr. et al. |
| 6,015,346 | A | | 1/2000 | Bennett |
| 6,019,369 | A | | 2/2000 | Nakagawa et al. |
| 6,033,307 | A | | 3/2000 | Vancura |
| 6,056,642 | A | | 5/2000 | Bennett |
| 6,059,289 | A | | 5/2000 | Vancura |
| 6,059,658 | A | | 5/2000 | Mangano et al. |
| 6,062,978 | A | | 5/2000 | Martino et al. |
| 6,062,980 | A | | 5/2000 | Luciano |
| 6,086,066 | A | | 7/2000 | Takeuchi et al. |
| 6,089,976 | A | | 7/2000 | Schneider et al. |
| 6,089,978 | A | | 7/2000 | Adams |
| 6,093,102 | A | | 7/2000 | Bennett |
| 6,095,921 | A | | 8/2000 | Walker et al. |
| 6,102,798 | A | | 8/2000 | Bennett |
| 6,117,009 | A | | 9/2000 | Yoseloff |
| 6,120,031 | A | | 9/2000 | Adams |
| 6,120,377 | A | | 9/2000 | McGinnis, Sr. et al. |
| 6,120,378 | A | | 9/2000 | Moody |
| 6,126,541 | A | | 10/2000 | Fuchs |
| 6,126,542 | A | | 10/2000 | Fier |
| 6,135,885 | A | | 10/2000 | Lermusiaux |
| 6,142,873 | A | | 11/2000 | Weiss et al. |
| 6,142,874 | A | | 11/2000 | Kodachi et al. |
| 6,142,875 | A | | 11/2000 | Kodachi et al. |
| 6,146,273 | A | | 11/2000 | Olsen |
| 6,149,156 | A | | 11/2000 | Feola |
| 6,149,521 | A | | 11/2000 | Sanduski |
| 6,155,925 | A | | 12/2000 | Giobbi et al. |
| 6,159,095 | A | | 12/2000 | Frohm et al. |
| 6,159,096 | A | | 12/2000 | Yoseloff |
| 6,159,097 | A | | 12/2000 | Gura |
| 6,159,098 | A | | 12/2000 | Slomiany et al. |
| 6,162,121 | A | | 12/2000 | Morro et al. |
| 6,168,520 | B1 | | 1/2001 | Baerlocher et al. |
| 6,168,523 | B1 | | 1/2001 | Piechowiak et al. |
| 6,173,955 | B1 | | 1/2001 | Perrie et al. |
| 6,174,233 | B1 | | 1/2001 | Sunaga et al. |
| 6,174,235 | B1 | | 1/2001 | Walker et al. |
| 6,179,711 | B1 | | 1/2001 | Yoseloff |
| 6,190,254 | B1 | | 2/2001 | Bennett |
| 6,190,255 | B1 | | 2/2001 | Thomas et al. |
| 6,200,217 | B1 | | 3/2001 | Osawa |
| 6,203,409 | B1 | | 3/2001 | Kennedy et al. |
| 6,203,428 | B1 | | 3/2001 | Giobbi et al. |
| 6,210,279 | B1 | | 4/2001 | Dickinson |
| 6,213,875 | B1 | | 4/2001 | Suzuki |

| | | | |
|---|---|---|---|
| 6,213,876 | B1 | 4/2001 | Moore, Jr. |
| 6,224,483 | B1 | 5/2001 | Mayeroff |
| 6,224,484 | B1 | 5/2001 | Okuda et al. |
| 6,227,970 | B1 | 5/2001 | Shimizu et al. |
| 6,231,442 | B1 | 5/2001 | Mayeroff |
| 6,231,445 | B1 | 5/2001 | Acres |
| 6,234,897 | B1 | 5/2001 | Frohm et al. |
| 6,238,287 | B1 | 5/2001 | Komori et al. |
| 6,238,288 | B1 | 5/2001 | Walker et al. |
| 6,241,607 | B1 | 6/2001 | Payne et al. |
| 6,251,013 | B1 * | 6/2001 | Bennett ..... 463/13 |
| D445,841 | S | 7/2001 | Sabo |
| 6,261,177 | B1 | 7/2001 | Bennett |
| 6,270,408 | B1 | 8/2001 | Sakamoto et al. |
| 6,270,409 | B1 | 8/2001 | Shuster |
| 6,270,411 | B1 | 8/2001 | Gura et al. |
| 6,270,412 | B1 | 8/2001 | Crawford et al. |
| 6,287,194 | B1 | 9/2001 | Okada et al. |
| 6,290,600 | B1 | 9/2001 | Glasson |
| 6,296,568 | B1 | 10/2001 | Tracy |
| 6,299,165 | B1 | 10/2001 | Nagano |
| 6,302,790 | B1 | 10/2001 | Brossard |
| 6,305,686 | B1 | 10/2001 | Perrie et al. |
| 6,309,300 | B1 | 10/2001 | Glavich |
| 6,312,334 | B1 | 11/2001 | Yoseloff |
| 6,315,660 | B1 | 11/2001 | DeMar et al. |
| 6,315,663 | B1 | 11/2001 | Sakamoto |
| 6,315,664 | B1 | 11/2001 | Baerlocher et al. |
| 6,319,124 | B1 | 11/2001 | Baerlocher et al. |
| 6,322,309 | B1 | 11/2001 | Thomas et al. |
| 6,328,649 | B1 | 12/2001 | Randall et al. |
| 6,334,814 | B1 | 1/2002 | Adams |
| 6,336,860 | B1 | 1/2002 | Webb |
| 6,336,863 | B1 | 1/2002 | Baerlocher et al. |
| 6,340,158 | B2 | 1/2002 | Pierce et al. |
| 6,346,043 | B1 | 2/2002 | Colin et al. |
| 6,347,996 | B1 | 2/2002 | Gilmore et al. |
| 6,358,147 | B1 | 3/2002 | Jaffe et al. |
| 6,364,766 | B1 | 4/2002 | Anderson et al. |
| 6,375,187 | B1 | 4/2002 | Baerlocher |
| D458,311 | S | 6/2002 | Seelig et al. |
| 6,398,218 | B1 | 6/2002 | Vancura |
| 6,398,644 | B1 | 6/2002 | Perrie et al. |
| 6,406,369 | B1 | 6/2002 | Baerlocher et al. |
| 6,413,160 | B1 | 7/2002 | Vancura |
| 6,413,161 | B1 | 7/2002 | Baerlocher et al. |
| 6,413,162 | B1 | 7/2002 | Baerlocher et al. |
| 6,416,408 | B2 | 7/2002 | Tracy et al. |
| 6,419,579 | B1 | 7/2002 | Bennett |
| 6,425,824 | B1 | 7/2002 | Baerlocher et al. |
| 6,435,511 | B1 | 8/2002 | Vancura et al. |
| 6,439,995 | B1 | 8/2002 | Hughs-Baird et al. |
| D463,504 | S | 9/2002 | Stephan |
| 6,443,837 | B1 | 9/2002 | Jaffe et al. |
| 6,454,266 | B1 | 9/2002 | Breeding et al. |
| 6,454,651 | B1 | 9/2002 | Yoseloff |
| 6,461,241 | B1 | 10/2002 | Webb et al. |
| 6,464,582 | B1 | 10/2002 | Baerlocher et al. |
| 6,468,156 | B1 | 10/2002 | Hughs-Baird et al. |
| 6,471,208 | B2 | 10/2002 | Yoseloff et al. |
| 6,481,713 | B2 | 11/2002 | Perrie et al. |
| 6,491,584 | B2 | 12/2002 | Graham et al. |
| 6,494,785 | B1 | 12/2002 | Gerrard et al. |
| 6,506,114 | B1 | 1/2003 | Estes et al. |
| 6,506,118 | B1 | 1/2003 | Baerlocher et al. |
| 6,511,375 | B1 | 1/2003 | Kaminkow |
| 6,514,141 | B1 | 2/2003 | Kaminkow et al. |
| 6,551,187 | B1 | 4/2003 | Jaffe |
| 6,554,703 | B1 | 4/2003 | Bussick et al. |
| 6,558,253 | B1 | 5/2003 | DeSimone et al. |
| 6,558,254 | B2 | 5/2003 | Baelocher et al. |
| 6,561,904 | B2 | 5/2003 | Locke et al. |
| 6,565,436 | B1 | 5/2003 | Baerlocher |
| 6,569,015 | B1 | 5/2003 | Baerlocher et al. |
| 6,569,016 | B1 | 5/2003 | Baerlocher |
| 6,572,471 | B1 | 6/2003 | Bennett |
| 6,572,473 | B1 | 6/2003 | Baerlocher |
| 6,575,830 | B2 | 6/2003 | Baerlocher et al. |
| 6,585,591 | B1 | 7/2003 | Baerlocher et al. |
| 6,589,114 | B2 | 7/2003 | Rose |
| 6,592,457 | B1 | 7/2003 | Frohm et al. |
| 6,595,854 | B2 | 7/2003 | Hughs-Baird et al. |
| 6,599,185 | B1 | 7/2003 | Kaminkow et al. |
| 6,599,192 | B1 | 7/2003 | Baerlocher et al. |
| 6,602,137 | B2 | 8/2003 | Kaminkow et al. |
| 6,605,002 | B2 | 8/2003 | Baerlocher |
| 6,607,437 | B2 | 8/2003 | Casey et al. |
| 6,609,974 | B2 | 8/2003 | Mead et al. |
| 6,632,139 | B1 | 10/2003 | Baerlocher |
| 6,632,141 | B2 | 10/2003 | Webb et al. |
| 6,634,941 | B2 | 10/2003 | Olive |
| 6,634,943 | B1 | 10/2003 | Baerlocher |
| 6,638,164 | B2 | 10/2003 | Randall et al. |
| 6,644,664 | B2 | 11/2003 | Muir et al. |
| 6,676,512 | B2 | 1/2004 | Fong et al. |
| 6,719,630 | B1 | 4/2004 | Seelig et al. |
| 6,746,329 | B1 | 6/2004 | Duhamel |
| 6,932,700 | B2 | 8/2005 | Bennett et al. |
| 2002/0025844 | A1 | 2/2002 | Casey et al. |
| 2002/0045475 | A1 | 4/2002 | Glavich et al. |
| 2002/0072402 | A1 | 6/2002 | Baerlocher |
| 2002/0094857 | A1 | 7/2002 | Meyer |
| 2002/0142822 | A1 | 10/2002 | Baerlocher et al. |
| 2002/0151350 | A1 | 10/2002 | Baerlocher et al. |
| 2002/0155883 | A1 | 10/2002 | Baerlocher |
| 2003/0013514 | A1 | 1/2003 | Cregan et al. |
| 2003/0040355 | A1 | 2/2003 | Baerlocher |
| 2003/0045344 | A1 | 3/2003 | Webb et al. |
| 2003/0045348 | A1 | 3/2003 | Palmer et al. |
| 2003/0054875 | A1 | 3/2003 | Marks et al. |
| 2003/0064795 | A1 | 4/2003 | Baerlocher et al. |
| 2004/0009803 | A1 | 1/2004 | Bennett et al. |
| 2004/0038731 | A1 | 2/2004 | Englman |
| 2005/0104298 | A1 | 5/2005 | Butcher et al. |

FOREIGN PATENT DOCUMENTS

| | | | |
|---|---|---|---|
| AU | A-50327/96 | | 10/1997 |
| AU | A-63553/98 | | 10/1998 |
| DE | 3700861 | A1 | 7/1988 |
| DE | 4014477 | A1 | 7/1991 |
| EP | 0 410 789 | A2 | 7/1990 |
| EP | 0 410 789 | A3 | 7/1990 |
| EP | WO 93/03464 | | 2/1993 |
| EP | 0688002 | A1 | 12/1995 |
| EP | 0 798 676 | A1 | 10/1997 |
| EP | 0874337 | A1 | 10/1998 |
| EP | 0926645 | A2 | 6/1999 |
| EP | 0 945 837 | A2 | 9/1999 |
| EP | 0944030 | A2 | 9/1999 |
| EP | 0984409 | A2 | 8/2000 |
| GB | 2 072 395 | A | 9/1981 |
| GB | 2 083 936 | A | 3/1982 |
| GB | 2 144 644 | A | 3/1985 |
| GB | 2 201 821 | A | 9/1988 |
| GB | 2 202 984 | A | 10/1988 |
| GB | 2 253 300 | A | 2/1992 |
| GB | 2 092 797 | | 8/1998 |
| GB | 2 328 311 | A | 2/1999 |
| WO | WO 9732285 | | 9/1997 |
| WO | WO 0012186 | | 3/2000 |

OTHER PUBLICATIONS

Enchanted Unicorn Advertisement written by IGT, published in 2001.
Pick'em Poker Plus Advertisement written by Ball Gaming Systems in 2002.
Penguin Pays written in Commentary in Strictly Slots/Aristocrat in Apr. 1999.
Super Cherry Advertisement written by International Game Technology in 2001.
1DU Dice Unit Advertisement [online] [retrieved from the internet May 14, 2001] <URL: http://www.starpoint.uk.com/1du.htm>.
3-Way Action Poker Brochure and Article written by written by IGT, published in 2002, on or before December thereof.
Addams Family Advertisement and Article written by IGT, Strictly Slots, published in 2000, on or before December thereof.
American Thunder Screen Shots written by IGT, published in 1998, on or before December thereof.
Bally Slot Machines Electro-Mechanicals 1964-1980 (on or before December thereof) Book [In Part], Revised 3rd Edition written by Marshall Fey.
Big Bang Piggy Bankin Advertisement written by WMS Gaming, Inc., published prior to 2000, on or before December thereof.
Bonus Times Article written by Bally Gaming, published in 2000, on or before December thereof.
Bunco Night Advertisement, International Game Technology, 2002, on or before December thereof.
By George Advertisement, International Game Technology, 2002, on or before December thereof.
Cash Box Advertisement & Article written by Anchor Games, Strictly Slots, published in 2000, on or before December thereof.
Cash Crop Brochure written by Arist O Crat Leisure Industries, published in 1997, on or before December thereof.
Chutes & Ladders Game Instructions written by Hasbro-Milton Bradley, published in 1999, on or before December thereof.
Cuckoo Aristocrat Brochure written by Aristocrat, published in Feb. 1998, on or before December thereof.
Dice Games Article describing Poker Dice, published prior to 2001, on or before December thereof.
Faster Harder More Challenging Q*bert game description [online] [retrieved from the Internet Mar. 12, 2002] written by The Killer List of Videogames, <URL:http://www.klov.com/F/Faster_Harder_More_Challenging_Q*bert.html>.
Field Testing New Slots Article, written by Strictly Slots, published in Jul. 2000.
Fire and Fortune Article in Strictly Slots, Anchor Games, May 2001.
Fox "N" Hound Advertisement written by IGT, published in 2000, on or before December thereof.
Free! 7-Day Trial on Daval's Reel Dice Advertisement written by Gerber & Glass, published in 1936, on or before Dec. thereof.
Fundamentals of Craps Book [In Part], written by Mason Malmuth and Lynne Loomis, published in 1995, on or before December thereof.
Good Times Brochure written by IGT, published in 1999, on or before December thereof.
Gotlieb Emulator Project written by Lee Taylor, [online] [retrieved from the Internet Mar. 12, 2002] <URL: http://www.defender.demon.co.uk/qbert.html>.
How to play Q*bert written by Gottlieb Amusement Games, [online] [retrieved from the Internet Mar. 12, 2002] <URL: http://users.rcn.com/e-glide/howto1.jpg> and <URL: http://users.rcn.com/e-glide/howto2.jpg>.
I Love Lucy Advertisement written by IGT, published in 2002, on or before December thereof.
In Between Game Descriptiont written by IGT, available prior to 2000, on or before December thereof.
Jackpot Party Brochures and Articles, written by WMS Gaming, Inc., published in 1998, on or before December thereof.
Leopard Spots™ (website) [online] [retrieved from the Internet Mar. 12, 2001] <URL: www.igt.com>.
Levy Patent Abstract writen by Derwent Publications Ltd., published in 1991, on or before December thereof.
Loaded Dice Strictly Slots Article, Konami, Dec. 2000.
Mega Multiplier® (website) [online] [retrieved from the Internet May 22, 2001] <URL: www.wmsgaming.com>.
Mikohn Solutions Article in the World Gaming Congress 2000 Edition, on or before December thereof.
Money Grab (website) [online] [retrieved fromt the Internet May 22, 2001] <IURL: www.wmsgaming.com>.
Money Grab Article written by Strictly Slots, published in Apr. 2001.
Money Mouse Brochure written by Arist O Crat Leisure Industries, published in 1997, on or before December thereof.
Monopoly Brochures and Articles written by WMS Gaming, Inc. published in 1998, on or before December thereof.
Monopoly Party Train Article written by Stricly Slots, published Feb. 2002.
Neon Nights written by IGT, published in 2000, on or before December thereof.
New Kids Article written by Strictly Slots, published in Dec. 2000.
On the Money Article written by Strictly Slots, Casino Data Systems, published in Dec. 2000.
Polly & Roger Brochure written by VLC, Inc, published in 2000, on or before December thereof.
Price is Right "Cliff Hangers" Description [online] [retrieved from the Internet Mar. 21, 2001] <URL: www.geocities.com; members.aol.com>.
Price is Right "Showcases" Description [online] [retrieved from the Internet Mar. 16, 2001] <URL: schuminweb.com>.
Q*bert board game instructions written by Parker Brothers, published in 1983, on or before December thereof.
Q*bert game description written by The Killer List of Videogames [online] [retrieved from the Internet Mar. 12, 2002] <URL: http://www.klov.com/Q/Q*bert.html>.
Q*bert video game advertisement written by Pennsylvania Gameroom Warehouse, [online] [retrieved from the Internet Mar. 12, 2002] <URL: http://www.gameroomwarehouse.com/videogame/qbert.html>.
Q*bert video game cartridge instruction for ATARI 2600 game system written by Parker Brothers, [online] [retrieved from the Internet Feb. 12, 2002] <URL: http://www.hasbro.com/default.asp?x=cc_gameand toyinstructions>.
Q*bert video game cartridge instructions for ATARI home computer written by Parker Brothers and Arcade/Action Software, [online] [retrieved from the Internet Mar. 12, 2002] <URL: http://www.hasbro.com/default.asp?x=cc_gameandtoyinstructions>.
Q*bert video game cartridge instructions for Colecovision game system written by Parker Brothers, [online] [retrieved from the Internet Mar. 12, 2002] <URL: http://www.hasbro.com/default.asp?x=cc_gameandtoyinstructions>.
Q*bert video game cartridge instructions for Commodore 64 game system written by Parker Brothers and Arcade/Action Software, [online] [retrieved from the Internet Mar. 12, 2002] <URL: http://www.hasbro.com/default.asp?x=cc_gameandtoyinstructions>.
Q*bert video game cartridge instructions for Intellivision game system written by Parker Brothers, [online] [retrieved from the Internet Mar. 12, 2002] <URL: http://www.hasbro.com/default.asp?x=cc_gameandtoyinstructions>.
Q*bert video game cartridge instructions for Texas Instruments 99/4A game system written by Parker Brothers and Arcade/Action Software, [online] [retrieved from the Internet Mar. 12, 2002] <URL: http://www.hasbro.com/default.asp?x=cc_gameandtoyinstructions>.
Q*bert: Classic Video Game Surrealism from the Golden Age of Arcade Games written by e-glide [online] [retrieved from the Internet Mar. 12, 2002] <URL: http://users.rcn.com/e-glide/qbert2.html>.
Q*bert's Qubes game description written by The Killer List of Videogames [online] [retrieved from the Internet Mar. 12, 2002] <URL: http://www.klov.com/Q/Q*bert's_Qubes.html>.
Q*bert video game advertisement for PlayStation [online] [retrieved from the Internet Mar. 12, 2002] <URL: http://www.amazon.com>.
Richard Petty Advertisement written by IGT, published in 2000, on or before December thereof.
Roll & Win Advertisement written by WMS Gaming, wmsgaming.com, printed Jun. 8, 2001.

Slot Machine Buyer's Handbook, A Consumer's Guide to Slot Machines [In Part] written by David L. Saul and Daniel R. Mead, published 1998, on or before December thereof.
Slot Machine A Pictorial History of the First 100 Years, 5th edition [In Part] written by Marshall Fey, published 1983 to 1997, on or before December thereof.
Slot Machine On Parade [In Part] written by Robert N. Geddes and illustrated by Daniel R. Mead, published 1980, on or before December thereof.
South Park—Dogeball Advertisement written by IGT, published in 2000, on or before December thereof.
Spam Article written by IGT, published in 2002, on or before December thereof.
Spell Binder Advertisment written by IGT, published 2000, on or before December thereof.
Stars, Bars and Bones Game Description written by P&M Coins, Inc. available 1997, on or before December thereof.
Super Cherry Advertisement writtten by International Game Technology in 2001.
Take Your Pick Advertisement written by IGT/Anchor Gaming, published in 1996, on or before December thereof.
Take Your Pick Article, Strictly Slots, published Mar. 2001.
Texas Tea Advertisement written by IGT, published in 2000, on or before December thereof.
The Creation of Q*Bert written by Warren Davis, [online] [retrieved from the Internet Mar. 12, 2002] <URL: http://www.coinop.org/features/qbstory.html>.
The History of Q*Bert written by Jeff Lee, [online] [retrieved from the Internet Mar. 12, 2002] <URL: http://users.aol.com/JPMLee/qbert.html>.
Top Dollar Brochure written by IGT, published in 1998, on or before December thereof.
Vision Series™/Good Times™ Brochure written by IGT, published in 1999, on or before December thereof.
Wheel Poker Article written by Strictly Slots (Anchor Games), published in Nov. 2000.
Winning Streak Web Site Description written by WMS Gaming Inc. (web site), printed on Mar. 21, 2001.
X Factor Brochure and Website Page written by WMS Gaming, Inc., published in 1998, on or before December thereof.
Yahtzee Bonus Advertisement, written by Mikohn Winning Solutions Worldwide, published in 1999, on or before December thereof.
Yahtzee Video Game Advertisement, written by Mikohn Winning Solutions Worldwide, published in 1999, on or before December thereof.

* cited by examiner

GAMING DEVICE HAVING SYMBOL STACKS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

CROSS-REFERENCE TO RELATED APPLICATION

This application is related to the following commonly-owned co-pending patent applications: "GAMING DEVICE HAVING DUAL EVALUATION SCHEME," Ser. No. 09/687,689.

BACKGROUND OF THE INVENTION

The present invention relates in general to gaming devices, and more particularly to gaming devices that randomly displays symbol stacks.

Gaming device manufacturers produce many different types of slot machines employing a plurality of reels which each have a plurality of symbols. When the player places a wager which causes the reels to spin, the slot machine produces a random generation of a combination of the symbols on the reels. If the generated combination or a portion of the combination matches one of a number of predetermined award producing or winning combinations, the player receives an award. The award is commonly one or more credits that the player can play or redeem for money.

To increase player enjoyment and excitement, and to increase the popularity of the gaming machines, gaming device manufacturers constantly strive to provide players with new features that add to the excitement and enjoyment generated by the gaming device. One element of gaming devices that receives considerable attention from the game designer is the displayed symbols. The generated symbols are the player's primary focus during the game because the symbols determine the player's outcome.

The symbols are often chosen to reflect the theme of the gaming device. The symbols typically have indicia that is interesting. To date, however, gaming devices have presented the symbols to the player via established techniques. For example, the symbols are on and thus move with the reels until the reels come to rest and display a portion of the reel strip to the player, which is typically three symbols from each reel strip. While players have become accustomed to these techniques, it is believed that adding variety to the standard techniques of symbol generation and display in gaming devices is desirable. Accordingly, a need exists for a different and exciting way to provide and present symbols to a player.

SUMMARY OF THE INVENTION

The present invention provides a gaming device and specifically a slot machine which includes a set of symbols. The gaming device randomly displays a portion of the symbols which are on a plurality of reel strips on a display device when the player plays a game of the gaming device. One or more positions on one or more of the reel strips of the present invention includes a stack of symbols or symbol stack. When the gaming device spins the reel strips and randomly displays a portion of the reel strips to the player, the portion can but does not have to display one or more symbol stacks.

The symbol stack includes an initially displayed symbol and at least one initially hidden symbol. In one embodiment, the hidden symbols are stacked or positioned beneath the initially displayed symbol. In another embodiment of the present invention, one of the initially hidden symbols visually replaces the initially displayed symbol so that a different set of visible symbols appears on the display device.

Each symbol stack includes a single initially hidden symbol or a plurality of initially hidden symbols. The initially hidden symbols are sequentially revealed after the gaming device removes or discontinues the display of a previously displayed symbol. If the symbol stack includes a plurality of initially hidden symbols, a second initially hidden symbol visually replaces the displayed first initially hidden symbol, and so on. Each removal creates a new set of symbols. Any one or all of the different sets may be evaluated to determine if a winning combination exists and if a payout is to be provided to the player.

In one embodiment, the symbol stack includes at least one hidden symbol, which is predetermined and associated with the initially displayed symbol. In this embodiment, the actual symbols that are hidden or stacked behind the initially displayed symbol are fixed and do not change from reel spin to reel spin. These hidden symbols are displayed in the fixed predetermined order. In another embodiment, the number or amount of hidden symbols stacked behind the initially displayed symbol are fixed but randomly chosen at the time of the removal of the initially displayed symbol. In another alternative embodiment, the hidden symbols can be randomly selected by the processor of the gaming device.

In one embodiment, the gaming device employs a slot game. The slot game includes a plurality of slot machine reels displayed on the display device, wherein each reel includes a plurality of standard slot machine symbols. One or more of the reels include one or more symbol stacks.

The symbol stacks in one embodiment appear randomly on the display device. Once a symbol stack appears, the removal of the displayed symbols may be implemented in various ways. In one embodiment, an initial triggering event causes removal of the displayed symbols or top-most symbol of the stack and the sequential appearance of one or more of the initially hidden symbols of the symbol stack. In another embodiment, a separate triggering event is required for each removal.

In one embodiment, the triggering event is simply the appearance of the symbol stack, for example, along an active or wagered upon slot machine payline. Here, the initially displayed symbol is automatically removed upon the random appearance of the symbol stack. Before each removal, the processor of the gaming device in one embodiment, makes a payout evaluation. In another embodiment, the processor of the gaming device makes a payout evaluation only upon certain removals.

Still further, a separate triggering event may be required. The separate triggering event can be a random event, for example, a symbol or combination of symbols appearing on the reels of a slot machine. The separate triggering event alternatively includes a player input. For example, the gaming device can employ a keep or trade type of game that lets the player determine whether to keep the current symbol or trade the current symbol for the next hidden symbol, if any. If the current combination is a winning combination, the player can keep the winning combination or risk it for a possibly more valuable winning combination.

The gaming device can display the revealing of the initially hidden symbols in a variety of ways. In one embodiment, the initially displayed symbols and the initially hidden symbols simply disappear. In another embodiment, graphical images show the top-most symbol being removed to expose one of the initially hidden symbols. In another embodiment, the initially hidden symbols are displayed in cooperation with the initially displayed symbol so as to appear as part of a three, four, five, etc., sided shape, which rotates. For purposes of clarification, the present application describes such a combination of symbols as a rotating symbol set. The rotating symbol set rotates to remove the display of an initially displayed symbol and display one or more of the initially hidden symbols. Here, the originally displayed symbol may be redisplayed one or more times.

With the rotating symbol sets, a random triggering event, such as a randomly displayed object or sprite, can move across the screen and appear to touch, knock or otherwise activate the rotating symbol set, so that the symbol set rotates and displays one or more of the initially hidden symbols. The symbol set alternatively rotates to display the initially hidden symbols and the initially displayed symbol multiple times. The gaming device can pay the player for each winning combination caused by the rotating symbol set or only for a winning combination produced by the displayed symbol when, for example, the symbol set comes to a stop.

In one embodiment, the gaming device provides a slot machine game having a plurality of the rotating symbol sets. For example, the slot machine can display a 3×5 matrix of the rotating symbol sets, which includes a first random generation to determine which rotating symbol sets from reel strips appear on the 3×5 matrix, and a second random generation that determines which symbols of the rotating symbol sets to display.

It is therefore an advantage of the present invention to provide a gaming device that includes symbol stacks having an initially displayed symbol and one or more initially hidden symbols.

Another advantage of the present invention is to provide a gaming device that automatically removes an initially displayed symbol to reveal one or more initially hidden symbols.

Still another advantage of the present invention is to provide a gaming device that displays an initially displayed symbol and one or more initially hidden symbols upon a player input.

Moreover, an advantage of the present invention is to provide an offer/acceptance or keep or trade type of game using symbol stacks.

Still further, an advantage of the present invention is to provide a gaming device having rotating symbol sets with two, three, four etc. sided shapes, wherein each side includes a different symbol.

Additional features and advantages of the present invention are described in, and will be apparent from, the following Detailed Description of the Invention and the figures.

DETAILED DESCRIPTION OF THE INVENTION

Gaming Device and Electronics

Figure 1A:
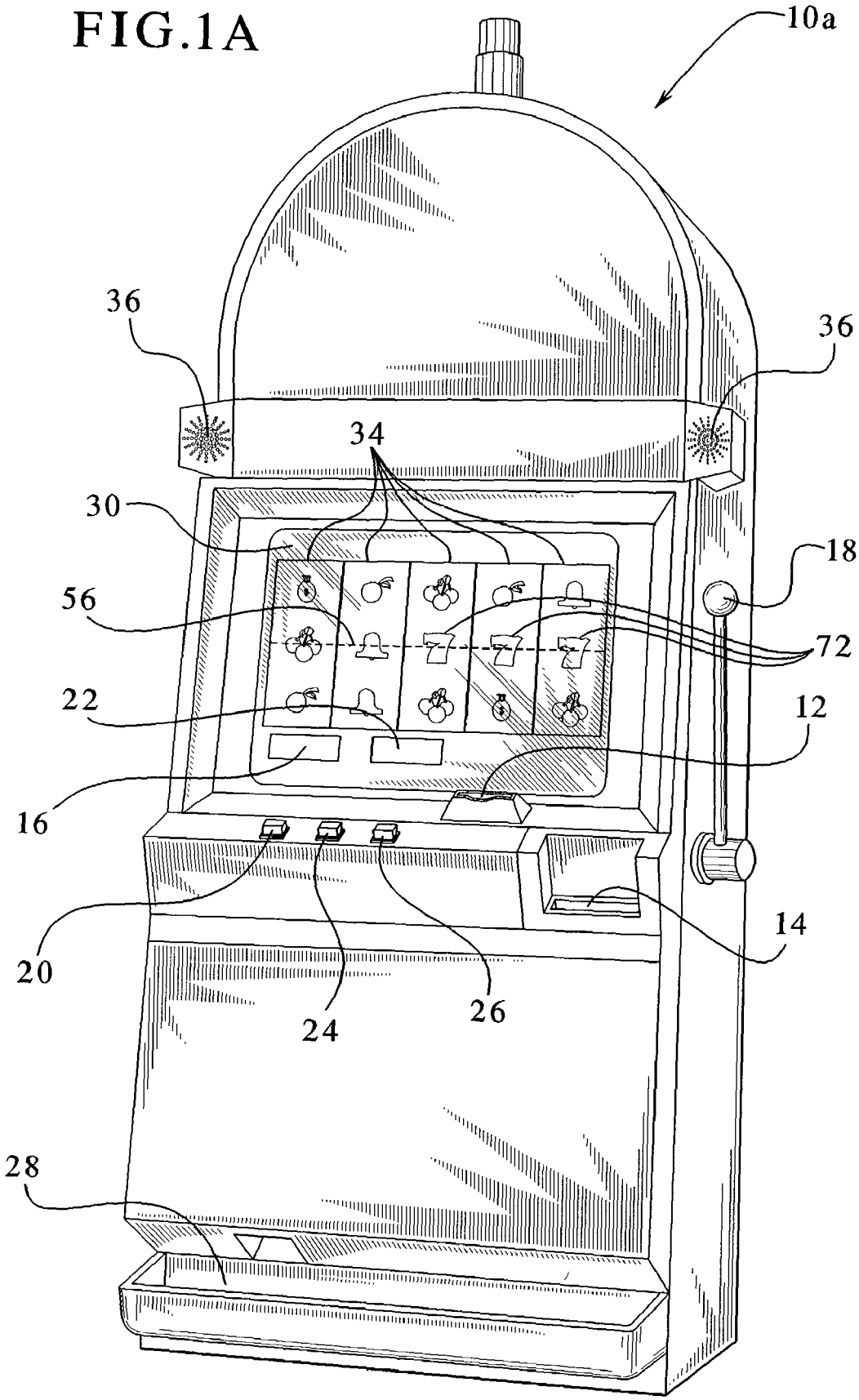
FIGS. 1A and 1B are perspective views of alternative embodiments of the gaming device of the present invention.
Figure 1B:
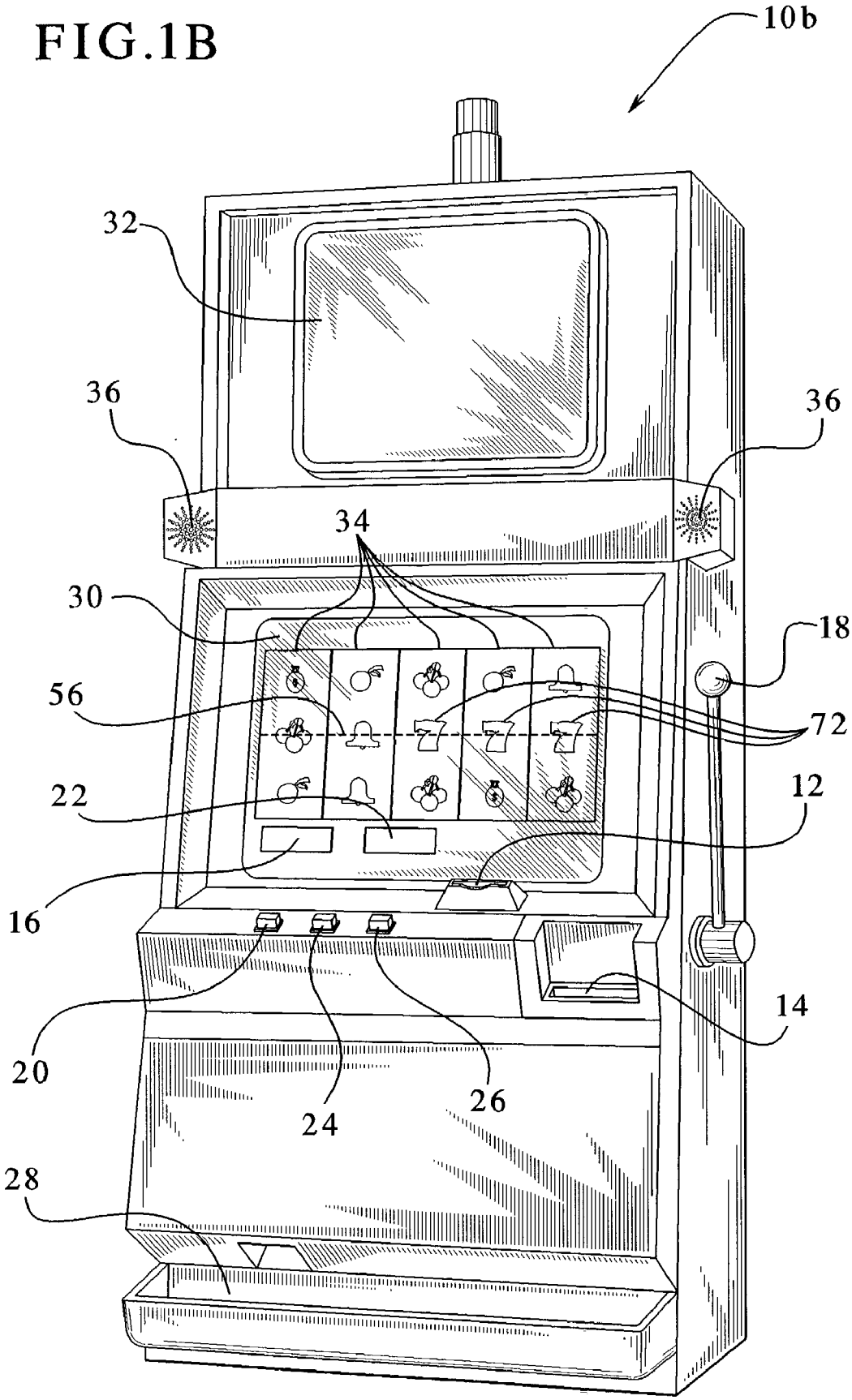

Referring now to the drawings, and in particular to FIGS. 1A and 1B, gaming device 10*a* and gaming device 10*b* illustrate two possible cabinet styles and display arrangements and are collectively referred to herein as gaming device 10. The gaming device of the present invention has the controls, displays and features of a conventional gaming machine. In various embodiments, the player operates gaming device 10 while standing or sitting. Gaming device 10 is alternatively a pub-style or table-top game (not shown), which a player preferably operates while sitting.

The gaming device 10, in certain embodiments, includes any suitable secondary or bonus triggering events, secondary bonus games as well as any progressive game coordinating with the primary or secondary games. Gaming device 10 also includes the symbols and indicia used for any of the base, bonus and progressive games include mechanical, electronic, electrical or video symbols and indicia.

The gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player begins the game by pulling arm 18 or pushing play button 20. Play button 20 includes any play activator used by the player, which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may cash out by pushing a cash out button 26 to receive coins or tokens in the coin payout tray 28 or other forms of payment, such as an amount printed on a ticket or credited to a credit card, debit card or smart card. Ticket printing and card reading machines (not illustrated) are known by and commercially available to those of skill in the art.

Gaming device 10 also includes one or more display devices. The embodiment shown in FIG. 1A includes a central display device 30, and the alternative embodiment shown in FIG. 1B includes a central display device 30 as well as an upper display device 32. The display device includes any viewing surface such as glass, a video monitor or screen, a liquid crystal display or any other static or dynamic display mechanism.

The slot machine base game of gaming device 10 of one embodiment displays a plurality of reels 34, preferably three to five reels 34, in video form on one or more of the display devices. Each reel 34 displays a plurality of indicia such as bells, hearts, fruits, numbers, letters, bars or other images or symbols which preferably correspond to a theme associated with the gaming device 10. The display device displaying the video reels 34 is preferably a video monitor. Each gaming device 10 includes speakers 36 for making sounds or playing music as described below. The reels display standard gaming device symbols as well as one or more of the symbol stacks 72 and/or one or more of the rotating symbols as discussed in detail below.

Figure 2:
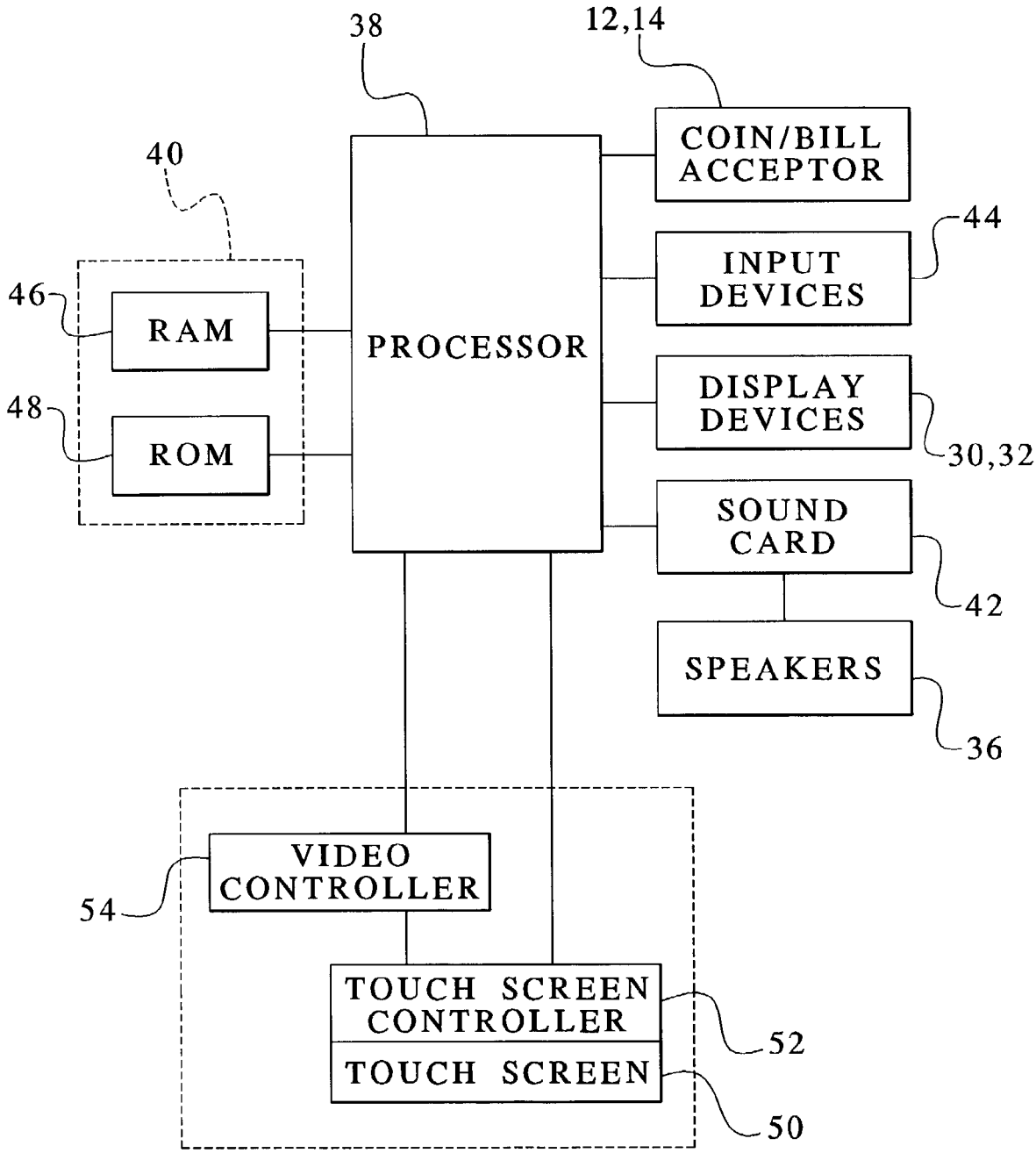
FIG. 2 is a schematic diagram of the electronic configuration of one embodiment of the gaming device of the present invention.

Referring now to FIG. 2, a general electronic configuration of the gaming device 10 preferably includes: a processor or central processing unit ("CPU") 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, objects, places and things. The memory device 40 includes random access memory ("RAM") 46 for storing event data or other data generated or used during a particular game. The memory device 40 also includes read only memory ("ROM") 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively or alternatively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, may also include one or more bonus games that give players the opportunity to win credits. The gaming device 10 may employ a video-based display device 30 or 32 or a mechanical device (not shown) for the bonus games.

In the slot machine embodiment, the qualifying condition may include a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the gaming device may include one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Figure 3A:
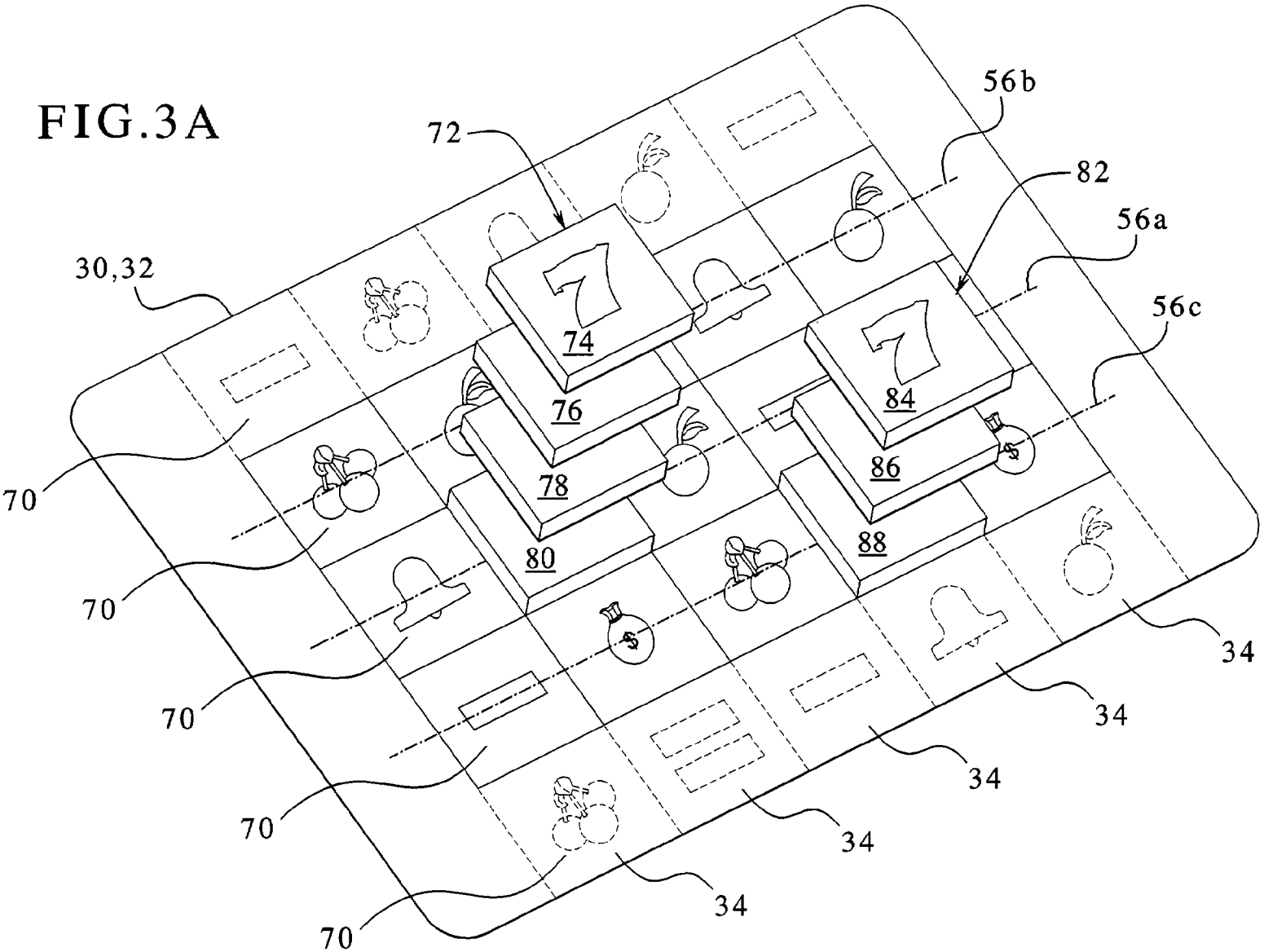
FIGS. 3A to 3D are perspective views of a display device displaying a set of slot machine reels having various embodiments of symbol stacks of the present invention.

Referring now to FIG. 3A, the video display device 30 or 32 illustrates the reels 34, wherein each reel includes a plurality of symbols 70. One or more of the reels may also include one or more symbol stacks 72 and 82 as shown above in FIGS. 1A and 1B. For purposes of comparison, two symbol stacks 72 and 82 are illustrated. Any percentage of the displayed reel symbol positions or pay stops may be symbol stacks depending on the quantity provided on the reel strips and the random outcome of the spinning reels or reel strips. Each of the symbol stacks 72 and 82 includes an initially displayed symbol 74 and 84, respectively, and a plurality of initially hidden symbols 76, 78 and 80 and 86 and 88, respectively.

The symbol stacks 72 and 82 each include a single initially displayed symbol 74 and 84, respectively, and any number of initially hidden symbols. For example, the symbol stacks 72 and 82 may include only a single initially hidden symbol. Otherwise, as illustrated, the symbol stacks 72 and 82 can include any number of associated hidden symbols. Symbol stack 72 includes three associated initially hidden symbols 76 to 80. Symbol stack 82 includes two associated initially hidden symbols 86 and 88.

The initially displayed symbols 74 and 84 of the symbol stacks 72 and 82, respectively, are removed first to reveal the first underlying initially hidden symbols 76 and 86, respectively. The initially hidden symbols 76 and 78 are then removed to reveal the remaining hidden symbols. For symbol stack 72, the initially hidden symbol 78 is revealed when the initially hidden 76 is removed and the initially hidden symbol 80 is revealed when the initially hidden symbol 78 is removed or no longer displayed on the display device 30 or 32.

For purposes of illustration, the initially displayed symbols 74 and 84 and a plurality of different initially hidden symbols for each are shown in a broken-out format. In one embodiment, the player at this point in the game only sees the initially displayed symbols 74 and 84 and may or may not know that behind these symbols lies one or a plurality of hidden symbols. Alternatively, the gaming device can visually or otherwise inform the player of the hidden symbols or the potential for hidden symbols. Further, the player may or may not be able to know how many hidden symbols lie behind the initially displayed symbols 74 and 84. For example, gaming device 10 in an embodiment informs the player that the initially displayed symbol 74 is part of a symbol stack 72 and informs the player how many initially hidden symbols are associated with the stack 72. Still further, the player may or may not be able to know exactly which symbols lie behind the symbols 74. Gaming device 10 could inform the player, for example, "the lucky 7 symbol hides a cherry symbol and a double bar." Some or all of this information may be provided as part of the paytable, which is accessible through a touch screen button on the display device 30 or 32. For example, the paytable could inform the player that the lucky "7" symbol hides two initially hidden symbols, while a lucky diamond symbol (not illustrated) hides three symbols.

Gaming device 10 may be modified so that each of the reel strips 34 includes one or more symbol stacks or so that only selected reels 34 include the symbol stacks. The number of reels including symbol stacks 72, the number of symbol stacks per reel and the number of initially hidden symbols are all determined in an embodiment in accordance with game mathematics.

In FIG. 3A, the display device 32 illustrates a three by five matrix of the symbols 70 and the symbol stacks 72 and 82. A row of symbols is also illustrated in phantom above and below the three by five matrix to illustrate that not all symbols on the reel strip are displayed by the display device. When the player presses the play button 20 or pulls the pull arm 18, the reels 34 spin so that different symbols along the reel strip move past the displayed three by five matrix of the display device 30 or 32. When the reels come to a stop, the gaming device displays a set of symbols, for example, the fifteen symbols in the three by five matrix of the display device 30 or 32.

In FIG. 3A, the display device initially displays the lucky "7" symbols which make-up the initially displayed symbols 74 and 84. As alluded to above, the initially displayed symbols can be the same or different for different reels or different positions on a given reel. Moreover, any given symbol stack, such as stacks 72 and 82, can display different initially displayed symbols at different times.

Upon displaying the first or initially displayed symbol of the stack, the processor may determine if there are any winning combinations and then pay the player for such winning combinations. As illustrated below, the display device proceeds to remove one or both of the initially displayed symbols 74 and 84 and reveal the first adjacent initially hidden symbol 76 and 78, respectively. That is, the symbol stacks 72 and 82 include a predetermined order of initially hidden symbols that may eventually be displayed.

The initially hidden symbols may be the same and in the same order for each of the symbol stacks 72 and 82 or the initially hidden symbols may be different or be in a different order for each of the symbol stacks 72 and 82. In an embodiment, the gaming device 10 includes a plurality of different symbol stacks 72 and 82, much the same as the gaming device includes different symbols 70. The gaming device 10 may then include one or more of each of the different types of symbol stacks.

In one embodiment, the symbol stacks 72 and 82 are fully predetermined. That is, the number of initially hidden symbols, the order of the initially hidden symbols and the content of each initially hidden symbol are predetermined. In another embodiment, only the number of initially hidden symbols is predetermined and the gaming device randomly generates a symbol (e.g., from the set of standard symbols 70) for the initially hidden symbol prior to it being displayed. In another embodiment, the gaming device 10 predetermines the content of the originally hidden symbols, e.g., 76, 78 and 80, etc., and then randomly determines how many originally hidden symbols to display. In still another embodiment, the number and possible content of the initially hidden symbols is predetermined but the order in which the initially hidden symbols are displayed is determined randomly. Still further alternatively, the initially hidden symbols may be fully randomly determined, wherein the number of, order of and type of initially hidden symbols are each randomly determined.

The symbol stacks 72 and 82 may be activated in a variety of ways. That is, the gaming device 10 may begin removing the initially displayed symbols 74 and 84 to reveal the initially hidden symbols in a variety of manners. In one embodiment, the symbol stacks 72 and 82 are auto executing. That is, whenever the reels 34 come to a stop and display a symbol stack, gaming device 10 thereafter automatically after a predetermined amount of time reveals one or more of the initially hidden symbols. In one embodiment, the gaming device 10 sequentially and automatically reveals each of the initially hidden symbols, e.g., 76, 78, 80, etc. In another embodiment, gaming device 10 automatically reveals less than all of the originally hidden symbols. For example, even though the originally hidden symbols are ordered, e.g., 76 to 80, the gaming device 10 can randomly generate how many of these to be displayed or generate the hidden symbols until a predefined condition is met.

To increase player excitement and enjoyment, gaming device 10 in an embodiment provides a graphical representation of the removal of either the initially displayed symbol 74 or 84 or one of the hidden symbols 76 to 80, 86 and 88. For example, a bomb could appear on display device 30, 32 and move over one of the lucky "7" symbols, wherein the bomb explodes and removes the "7" to reveal one of the hidden symbols. Alternatively, multiple explosions could occur, each explosion resulting in the display of one of the hidden symbols.

In one embodiment, the symbol stacks 72 and 82 are player activated. For example, the display device 30 or 32 can integrate with a touch screen 50 and a touch screen controller 52 and enable the player to touch one or both of the symbol stacks 72 and 82 to activate same. Otherwise, gaming device 10 provides any suitable known type of input device 44 to allow the player to activate one or both of the symbol stacks 72 and 82. For example, gaming device 10 can inform the player that the symbol "7" is an initially displayed symbol of a symbol stack. The gaming device may then provide the player with, for example, three symbol stack activations, so that when gaming device 10 generates a symbol stack 72 or 82, the player can then decide whether to use one of the three designated activations. Gaming device 10 may otherwise allow the player to purchase symbol stacks for one or more gaming device credits. Any time the symbol "7" appears, the player can then select to initiate one of the player's accrued symbol stacks. This enables the player to wait until one of the symbol stacks appears in between two like symbols or two symbols of a winning combination, wherein the player determines or hopes that one of the initially hidden symbols provides the missing piece to the winning combination.

Figure 3B:
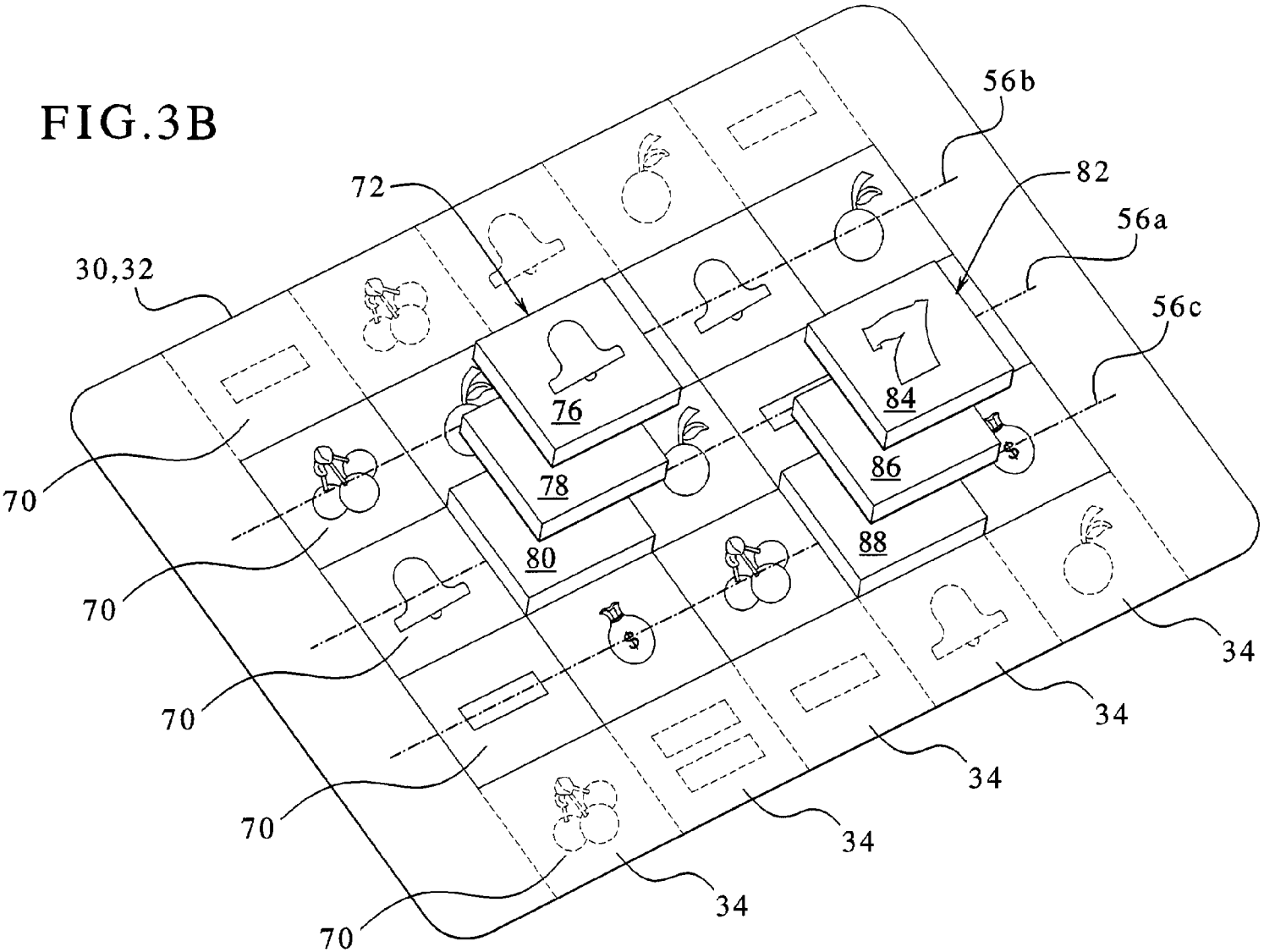

Referring now to FIG. 3B, the gaming device 10 in an embodiment pays for each winning combination provided by the initially displayed symbols 74 and 84 and each of the initially hidden symbols 76 to 80, 86 and 88, etc. For example, if the two displayed "bell" symbols along the active payline 56*a* form a winning combination, gaming device 10 awards the player a number of credits when the "bell" symbol 76 is in place of the initially displayed symbol 74 of the symbol stack 72. If, for example, both the initially hidden symbols 76 and 80 of symbol stack 72 include the "bell" symbol, gaming device 10 pays the player twice for that combination. The initially displayed symbol 74 may also form part of a winning combination so that the gaming device 10 pays a player a number of credits before removing the initially displayed symbol and revealing one of the initially hidden symbols.

Figure 3C:
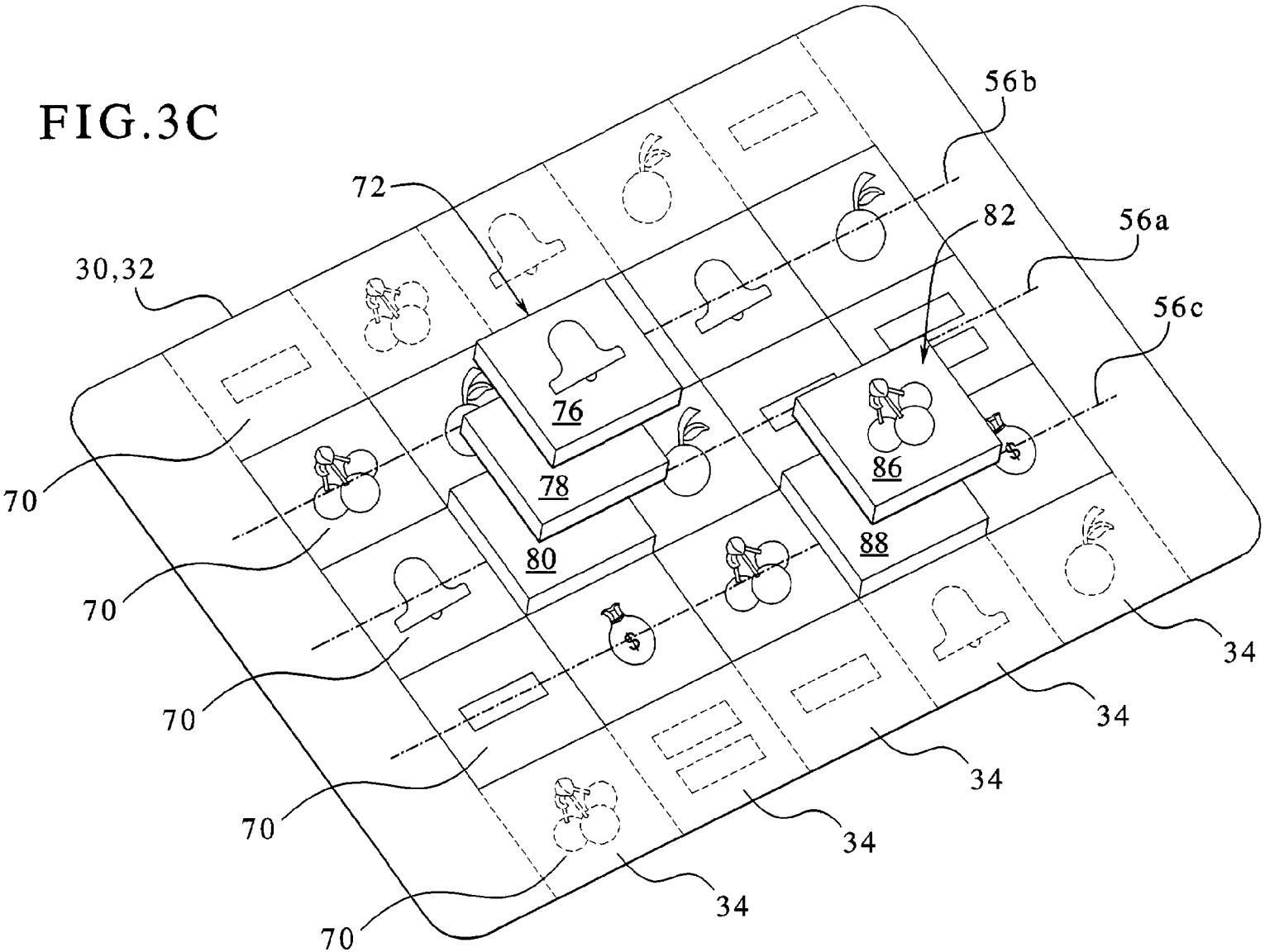

As illustrated by FIG. 3C, gaming device 10 may sequentially activate more than one symbol stack. FIG. 3C illustrates that each symbol stack has been activated so that the "bell symbol" 76 (from stack 72) appears on active payline 56*a* and so that the cherry symbol 86 (from stack 82) appears on active payline 56*c*. The gaming device can pay for any combination caused by the display of symbols 76 and 86 of the symbol stacks 72 and 82. In another embodiment, gaming device 10 activates symbol stacks 72 and 82 regardless of whether they fall upon an active payline.

In another embodiment, another randomly determined event needs to occur in order for a symbol stack 72 or 82 to be executed. For example, gaming device 10 may require that another symbol or other symbol combination also appear on an active (or inactive) payline 56*a* to 56*c*. The gaming device 10 could require that the player randomly receive a symbol stack 72 or 82 and randomly receive an activator such as a separate symbol or symbol combination. For example, gaming device 10 could require the "bar" and "grape" symbols to appear along an active payline, as seen along the active payline 56*c* in FIG. 3A, in order for one or both of the symbol stacks 72 and 82 to change, e.g., to the symbols 76 and 86, respectively, in FIGS. 3B and 3C. In another embodiment, it is possible for the player to accumulate the symbol stacks and/or to accumulate the activator symbol or symbol combinations. The gaming device in this instance activates a symbol stack whenever the player has accumulated both a symbol stack and the symbol stack activator.

In a further embodiment, gaming device 10 sequentially displays the initially hidden symbols 76, 78 and 80 or 86 then 88, until displaying a winning symbol or symbol combination if any can be achieved. Here, gaming device 10 pays out one or a limited number of times. For example, instead of the lucky "7", the initially displayed symbols 74 and 84 may be a ghost symbol or no symbol. The gaming device 10 then scrolls through a number of initially hidden symbols until one of them produces a winning symbol or symbol combination or until there are no more initially hidden symbols. At this point, gaming device 10 pays out for the winning combination and returns the player to normal gaming operation, regardless of whether one or more initially hidden symbols still remain hidden.

Figure 3D:
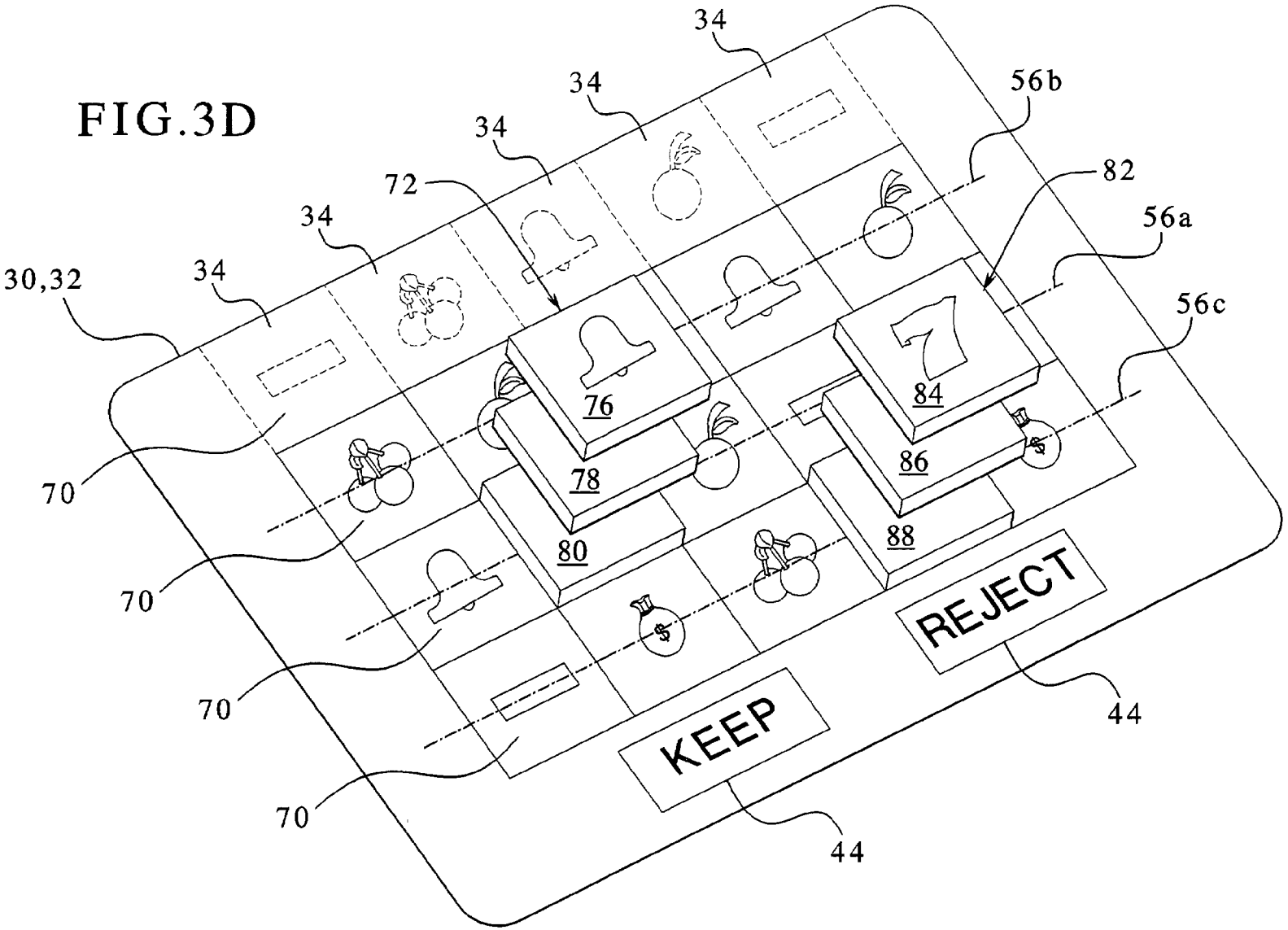

In a further alternative embodiment illustrated by FIG. 3D, gaming device 10 combines the symbol stacks with a keep or trade type of game. A keep or trade game, commonly referred to as an offer/acceptance game, enables the player to choose whether or not to keep a particular offer, in this case, a particular combination of symbols or whether to continue changing the combination of symbols. In the illustrated embodiment, the initially displayed symbol 74 or 84 does not provide a winning combination or a winning combination suitable to the player, so that the player selects the reject input device 44, which causes the hidden symbol 76 to be revealed after the initially displayed symbol 74 is removed. If the player does not wish to keep the displayed "bell," "bell" combination caused by the initially hidden symbol 76, the player can select the reject input device 44 again to reveal the initially hidden symbol 78 and so on. Where two symbol stacks 72 and 82 appear in combination with the keep and reject inputs 44 as shown in FIG. 3D, gaming device 10 can activate the symbol stacks 72 and 82 sequentially and let the player play two or more individual offer/acceptance games.

Gaming device 10 may use one of the symbols of the actual symbol stacks 72 or 82 as either the keep or reject input 44. For example, the player can sequentially select the initially displayed symbol 74 and the hidden symbols 76, 78 and 80 of the stack 72 until finding a desirable combination, wherein the player selects a separate accept or keep input 44. Alternatively, the player sequentially selects the reject input 44 until finding a desirable hidden symbol, wherein the player selects the desired hidden symbol to keep same. Gaming device 10 awards any winning combination produced by the initially hidden symbol that the player has selected.

FIG. 3D illustrates the accept and reject inputs 44 as being simulated areas that cooperate with the touch screen 50 and controller 52. In an alternative embodiment, the accept and reject inputs 44 are electromechanical input devices that send discrete inputs to the processor 38. If gaming device 10 displays each initially hidden symbol of a symbol stack 72 or 82, and the player does not accept any of these, gaming device 10 provides any award created by the final initially hidden symbol and returns the player to regular gaming activities.

Figure 4:
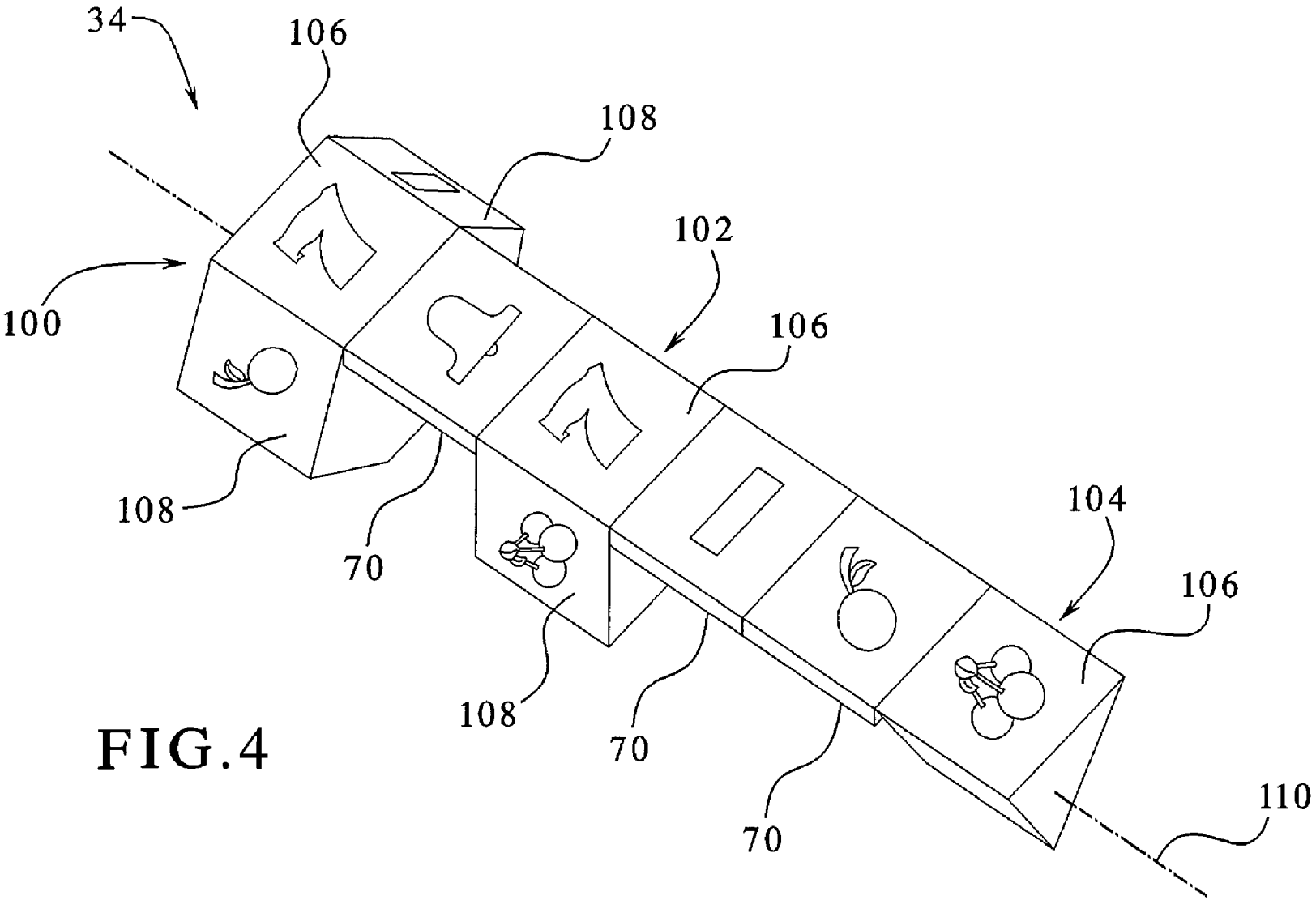
FIG. 4 is a perspective view of a display device displaying a slot machine reel having the rotatable symbol sets of the present invention.

Referring now to FIG. 4, another embodiment of the present invention is illustrated, wherein the originally hidden symbols are configured in a shape with the originally displayed symbol so that the shape or set of symbols rotates to sequentially reveal the initially hidden symbols. The rotating shapes are illustrated in combination with a slot machine reel 34.

The reel 34 in FIG. 4 represents one reel of a slot machine game and in a preferred embodiment operates with other reels 34, which may have one or more rotating symbol sets. The reel 34 includes the symbols 70. The reel 34 also includes one or more and in the illustrated embodiment three different rotating symbol sets 100, 102 and 104. The reel 34 also includes other symbols that are not illustrated.

As illustrated, the rotating symbol set 100 includes a six-sided or hexagonal shape. The rotating symbol set 102 includes a four-sided square or rectangular shape. The rotating symbol set 104 includes a three-sided or triangular shape. The rotating symbols can include any suitable number of sides. Gaming device 10 can or alternatively does not reveal the shape or the number of hidden symbols 108 associated with a set. Further, not every face of the set has to include a symbol 106 or 108.

Each of the rotating symbol sets 100, 102 and 104 includes, like the symbol stacks described above, an initially displayed symbol 106 and a plurality of initially hidden rotatable symbols 108. The rotating symbol set 100 includes five initially hidden rotatable symbols 108. The rotating symbol set 102 includes three initially hidden rotatable symbols 108. The rotating symbol set 104 includes two initially hidden rotatable symbols 108.

In operation, the rotating symbol sets rotate either in a clockwise or counterclockwise manner about a central axis 110. The rotating symbol sets 100, 102 and 104 rotate in a direction that is generally perpendicular to the direction that the reel strip 34 moves along the display device 30 or 32. The rotating symbol sets 100, 102 and 104, like the symbol stacks described above, provide the game implementor with an additional degree of freedom in designing random combination possibilities. The rotating symbol sets also provide the game implementor with a variety of visual display options that make the gaming device more fun and entertaining for the player.

One display option that is available includes some type of action that occurs in a horizontal (or non-vertical) direction across the display device 30 or 32. The reels generally spin in a vertical direction and come to a stop, displaying a plurality of the standard symbols 70 and the rotating symbol sets, such as sets 100, 102 and 104. In one embodiment, gaming device 10 displays an object or sprite that moves horizontally across the screen and hits or clips one or more of the rotating symbols, so that the symbols rotate in a clockwise or counterclockwise direction about the axis, such as axis 110. The symbols can rotate for less than one full rotation. Otherwise, the rotating symbols can rotate for multiple rotations. In one alternative embodiment, the initially displayed symbol 106 and possibly one or more of the hidden symbols 108 of the rotating symbol sets 100, 102 and 104 may reappear one or more times. That is, the spinning action may randomly reveal the initially displayed symbol 106 multiple times.

The triggering events described above for the symbol stacks 72 and 82 can also be implemented with the rotating symbol sets 100, 102 and 104. In an embodiment, the rotating symbol sets automatically rotate upon being generated along one of the reels 34. In another embodiment, the player determines when to rotate one of the sets. For example, in an embodiment, each of the symbols on the display device 30 or 32 is potentially a rotating symbol set, wherein when the player selects one of the symbols cooperating with a touch screen or contacts an input device 44, gaming device 10 randomly chooses one of the sets to rotate to display one of the initially hidden symbols 108 or to redisplay the initially displayed symbol 106. In a further embodiment, the rotating symbol sets rotate upon some other random generation by gaming device 10, such as the generation of one or more of the standard symbols 70.

Each of the payout evaluation embodiments described above for the symbol stacks 72 and 82 also applies to the rotating symbol sets 100, 102 and 104. For example, gaming device 10 in an embodiment pays out for each winning combination generated by each initially hidden rotated symbol 108 that is displayed on the display device 30 or 32. In another embodiment, the gaming device 10 pays out the first winning combination generated by a display of one of the originally hidden rotated symbols 108. In this latter embodiment, the gaming device 10 in an embodiment rotates the symbol in either the clockwise or counterclockwise direction about the axis 110 until one of the originally hidden symbols 108 creates a winning combination for the player. At this point, gaming device 10 no longer rotates the rotating symbol set.

The rotating symbol sets 100, 102 and 104 may also be employed in a keep or trade type game. Here, the player operates with the keep and trade input devices 44, which enable the player to either keep or trade the originally displayed symbol 106 or one of the originally hidden rotated symbols 108. In this manner, the player may rotate the symbol set 100, 102 or 104 to attempt to make a winning combination or attempt to upgrade a winning combination. In this embodiment, gaming device 10 does not allow the originally displayed symbol 106 to be redisplayed or the rotating symbol set to rotate past one turn.

In the keep or trade game, the player in one embodiment does not know how many sides or faces the shape of the rotating symbol set has, so that the player cannot readily gauge whether to accept a lesser paying combination. In another embodiment, the display device 30 or 32 graphically enables the player to see whether the shape is for example a hexagon, square or triangle, so that the player has some idea of whether or not to take or discard a lesser paying winning combination.

Figure 5:
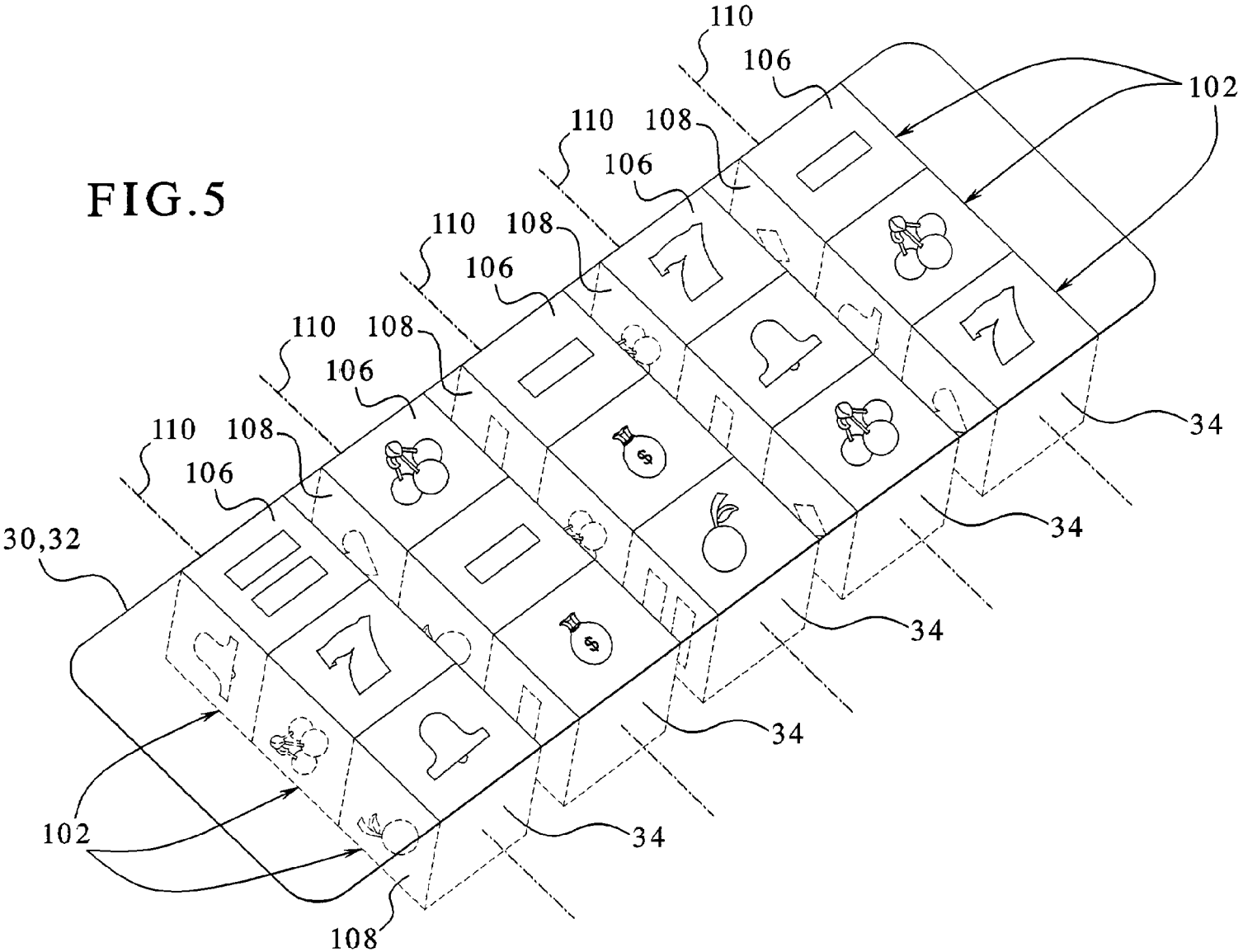
FIG. 5 is a perspective view of a display device displaying a set of slot machine reels each having the rotatable symbol sets of the present invention.

Referring now to FIG. 5, an embodiment of gaming device 10 employs reels 34 that include only rotating symbol sets, in this case the four-sided rotating symbol sets 102 (of FIG. 4). The sets could include other shapes and other numbers of symbols. Each of the symbol sets 102 of the reels 34 includes an initially displayed symbol 106 and a plurality of initially hidden rotatable symbols 108. In this embodiment each of the rotating symbol sets 102 includes three initially hidden rotatable symbols 108, wherein the sets generally include symbols bearing different indicia. The rotating symbol sets 102 can, however, include any number and type of symbols, including one or more of the same hidden symbols and/or including one or more blank or ghost symbols.

Each of the reels 34 has an axis of rotation 110. Each reel 34 can collectively rotate in the same direction or rotate in different directions with respect to the other reels 34. In addition, two sets 102 on the same reel 34 can rotate in different directions. After the rotating sets 102 stop rotating, the display device 30 or 32 displays a matrix of initially displayed and/or hidden symbols, such as a three by five matrix of said symbols. The rotating symbol sets 102 rotate about a first axis, while the reels 34 rotate about a second axis so that the sets 102 and reels 34 provide a two-dimensional slot game.

The rotating sets 102 generally rotate in a perpendicular direction to the spinning of the reels 34. The perpendicular motions can coordinate with one another in a variety of ways. In one embodiment, the rotating symbol sets 102 automatically spin as the reels 34 spin, wherein the reels 34 come to a stop at a point in time before the rotating symbol sets 102 come to a stop or vice versa. The reels 34 can come to a stop at different times with respect to one another as can the rotating symbol sets 102.

As described above, in one embodiment, a random event is required in order to cause one or more or all of the rotating sets to rotate. In a further alternative embodiment, the gaming device 10 provides one or more electromechanical inputs 44 or a touch screen 50 in cooperation with the sets 102 that enable the player to cause the rotating symbol sets 102 to rotate.

Any of the payout schemes described above may be implemented with the rotating symbol sets and the two-dimensional rotation of FIG. 5. The device can payout for each winning symbol or symbol combinations caused before and/or after one or more of the sets rotates. In another embodiment, gaming device 10 only pays out for one winning combination. In a still further embodiment, the rotating sets, such as the rotating slot machine symbol sets 102, may be combined with one or more symbol stacks, such as slot machine symbol stacks 72 and 82 described above.

It should thus be appreciated from the above description and figures that the present invention provides a gaming device having two dimensional reel strips which facilitate a three dimensional display based on the removal of the initially displayed symbols and revealing of the initially hidden symbols. The third dimension for the symbols on the reel strip is the height of the multiple symbols.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

a plurality of video reels, each one of the video reels having a reel strip;

a plurality of symbols on each one of the reel strips;

a symbol stack on at least one of the video reels, the symbol stack including an initially displayed one of said symbols and an initially hidden one of said symbols, the initially displayed symbol being used to determine an occurrence of a game outcome;

a display device operable to display the video reels; and a processor that controls the display device, the video reels and the symbol stack on the video reels, the processor programmed to cause the display device to simultaneously display:

(a) the symbol stack, and (b) at least one of the symbols positioned:

(i) on the reel strip of the symbol stack, and (ii) adjacent to said symbol stack.

2. The gaming device of claim 1, which includes a plurality of the symbol stacks on one of the reel strips.

3. The gaming device of claim 1, which includes at least one of the symbol stacks on each of the reel strips.

4. The gaming device of claim 1, wherein the symbol stack includes a plurality of initially hidden symbols.

5. The gaming device of claim 1, which a plurality of the symbol stacks each having a plurality of initially hidden symbols.

6. The gaming device of claim 1, wherein the symbol stack includes a predetermined number of initially hidden symbols in a predetermined order.

7. The gaming device of claim 1, wherein the symbol stack includes a predetermined number of initially hidden symbols in a randomly determined order.

8. The gaming device of claim 1, wherein the symbol stack includes a randomly determined number of initially hidden symbols in a predetermined order.

9. The gaming device of claim 1, wherein the symbol stack includes a randomly determined number of initially hidden symbols in a randomly determined order.

10. The gaming device of claim 1, wherein the initially displayed symbol is removed to reveal the initially hidden symbol upon a random event.

11. The gaming device of claim 1, wherein the initially displayed symbol is removed to reveal the initially hidden symbol upon a player input.

12. The gaming device of claim 1, wherein the initially displayed symbol is removed in conjunction with a graphical display to reveal the initially hidden symbol.

13. The gaming device of claim 1, which includes a graphical display of how many hidden symbols are included in the symbol stack.

14. The gaming device of claim 1, which includes a plurality of initially displayed symbols that are, upon a randomly determined event, sequentially revealed upon the removal of the initially displayed symbol and each previously revealed initially hidden symbol.

15. The gaming device of claim 1, which includes a plurality of initially hidden symbols that are, upon at least one player input, sequentially revealed upon the removal of the initially displayed symbol and each previously revealed initially hidden symbol.

16. The gaming device of claim 1, which includes a plurality of symbol stacks displayed on the reel strips, wherein initially displayed symbols of the stacks are simultaneously removed to reveal the initially hidden symbols.

17. The gaming device of claim 1, which includes a first award evaluation using the initially displayed symbol and a second award evaluation using the initially hidden symbol.

18. The gaming device of claim 1, which includes a graphical representation of the initially displayed symbol being removed and the initially hidden symbol being revealed.

19. A gaming device comprising:

a plurality of virtual reels, each one of the virtual reels having a reel strip;

a plurality of symbols on each one of the reel strips;

at least one symbol stack on at least one of the reel strips, the symbol stack including an initially displayed symbol and an initially hidden symbol, the initially displayed symbol being used to determine an occurrence of a game outcome;

a display device operable to display the video reels; and a processor which controls the display device, the processor operable to:

(a) cause the display device to simultaneously display the initially displayed symbol of the symbol stack and at least one of the symbols positioned:

(i) on the reel strip of said symbol stack, and (ii) adjacent to the symbol stack, (b) evaluate the symbols randomly generated on any of the virtual reels before the initially displayed symbol is removed, said evaluation including an evaluation of the initially displayed symbol, and (c) evaluate the symbols randomly generated on any of the virtual reels after: (i) the initially displayed symbol is removed, and (ii) the initially hidden symbol is revealed, said evaluation including an evaluation of the initially hidden symbol.

20. The gaming device of claim 19, which includes a plurality of symbol stacks on one of the reel strips.

21. The gaming device of claim 19, which includes at least one symbol stack on each of the reel strips.

22. The gaming device of claim 19, which additionally includes a rotatable symbol set having an initially displayed symbol and a plurality of initially hidden symbols.

23. The gaming device of claim 19, which includes a plurality of symbol stacks each having a plurality of initially hidden rotatable symbols.

24. The gaming device of claim 19, wherein the symbol stack includes a predetermined number of initially hidden symbols in a predetermined order.

25. The gaming device of claim 19, wherein the symbol stack includes a predetermined number of initially hidden symbols in a randomly determined order.

26. The gaming device of claim 19, wherein the symbol stack includes a randomly determined number of initially hidden symbols in a predetermined order.

27. The gaming device of claim 19, wherein the symbol stack includes a randomly determined number of initially hidden symbols in a randomly determined order.

28. The gaming device of claim 19, wherein the initially displayed symbol is removed to reveal the initially hidden symbol upon a random event.

29. The gaming device of claim 19, wherein the initially displayed symbol is removed to reveal the initially hidden symbol upon a player input.

30. The gaming device of claim 19, wherein the initially displayed symbol is removed in conjunction with a graphical display to reveal the initially hidden symbol.

31. The gaming device of claim 19, which includes a graphical display of how many hidden symbols are associated with the symbol stack.

32. A gaming device comprising:

a plurality of virtual reels, each one of the virtual reels having a reel strip;

a plurality of symbols on each one of the reel strips;

at least one symbol stack on at least one of the reel strips, the symbol stack including an initially displayed symbol and an initially hidden symbol, the initially displayed symbol being used to determine an occurrence of a game outcome;

a display device operable to display the virtual reels; and a processor operable to cause the display device to:

(a) simultaneously display the initially displayed symbol of the symbol stack and at least one of the symbols positioned:

(i) on the reel strip of said symbol stack, and (ii) adjacent to said symbol stack, and (b) reveal the initially hidden symbol after the the initially displayed symbol is removed.

33. The gaming device of claim 32, which includes a plurality of symbol stacks on one of the reel strips.

34. The gaming device of claim 32, which includes at least one symbol stack on each of the reel strips.

35. The gaming device of claim 32, wherein the symbol stack includes a plurality of initially hidden symbols.

36. The gaming device of claim 32, which includes a plurality of symbol stacks each having a plurality of initially hidden symbols.

37. The gaming device of claim 32, wherein the symbol stack includes a predetermined number of initially hidden symbols in a predetermined order.

38. The gaming device of claim 32, wherein the symbol stack includes a predetermined number of initially hidden symbols in a randomly determined order.

39. The gaming device of claim 32, wherein the symbol stack includes a randomly determined number of initially hidden symbols in a predetermined order.

40. The gaming device of claim 32, wherein the symbol stack includes a randomly determined number of initially hidden symbols in a randomly determined order.

41. The gaming device of claim 32, wherein the initially displayed symbol is removed to reveal the initially hidden symbol upon a random event.

42. The gaming device of claim 32, wherein the initially displayed symbol is removed to reveal the initially hidden symbol upon a player input.

43. The gaming device of claim 32, wherein the initially displayed symbol is removed in conjunction with a graphical display to reveal the initially hidden symbol.

44. The gaming device of claim 1, wherein the game outcome includes a display of: (a) a designated one of the symbols, or (b) a designated combination of the symbols.

45. The gaming device of claim 1, wherein the game outcome includes a winning outcome or a losing outcome.

46. The gaming device of claim 19, wherein the game outcome includes a display of: (a) a designated one of the symbols, or (b) a designated combination of the symbols.

47. The gaming device of claim 19, wherein the game outcome includes a winning outcome or a losing outcome.

48. The gaming device of claim 32, wherein the game outcome includes a display of: (a) a designated one of the symbols, or (b) a designated combination of the symbols.

49. The gaming device of claim 32, which the game outcome includes a winning outcome or a losing outcome.

* * * * *